US010561223B2

(12) United States Patent
Crawford et al.

(10) Patent No.: US 10,561,223 B2
(45) Date of Patent: Feb. 18, 2020

(54) CONSUMABLE PRODUCT PACKAGING

(71) Applicant: Colgate-Palmolive Company, New York, NY (US)

(72) Inventors: John Crawford, Mahopac, NY (US); Kiat-Cheong Toh, Forest Hills, NY (US)

(73) Assignee: Colgate-Palmolive Company, New York, NY (US)

( * ) Notice: Subject to any disclaimer, the term of this patent is extended or adjusted under 35 U.S.C. 154(b) by 59 days.

(21) Appl. No.: 15/759,980

(22) PCT Filed: Sep. 16, 2015

(86) PCT No.: PCT/US2015/050333
§ 371 (c)(1),
(2) Date: Mar. 14, 2018

(87) PCT Pub. No.: WO2017/048243
PCT Pub. Date: Mar. 23, 2017

(65) Prior Publication Data

US 2018/0249809 A1 Sep. 6, 2018

(51) Int. Cl.
*A45D 40/22* (2006.01)
*A45D 40/02* (2006.01)
(Continued)

(52) U.S. Cl.
CPC ..... *A45D 40/22* (2013.01); *A45D 40/02* (2013.01); *A45D 40/04* (2013.01); *A45D 2040/005* (2013.01); *A45D 2040/0037* (2013.01)

(58) Field of Classification Search
CPC ..... A45D 40/22; A45D 40/04; A45D 40/02; A45D 2040/0037; A45D 2040/005;
(Continued)

(56) References Cited

U.S. PATENT DOCUMENTS 5,255,990 A 10/1993 Dornbusch et al.
5,399,040 A * 3/1995 Holloway ..... A45D 40/06 401/78
(Continued)

FOREIGN PATENT DOCUMENTS

FR 2942115 8/2010
JP S60-129209 U 8/1985
(Continued)

OTHER PUBLICATIONS

International Search Report and Written Opinion of the International Searching Authority in International Application No. PCT/US2015/050333, dated May 31, 2016.

*Primary Examiner* — David J Walczak

(57) ABSTRACT

A consumer product (100) includes a housing (110) defining an internal volume. A door (130) is coupled to the housing, and the door is configured to move between an open position and a closed position. The door includes an actuating device (132) positioned on a first side of the door and configured to be actuated by a user. The door also includes a first portion (310) of a clutch (300) positioned on a second side of the door. The first portion of the clutch rotates in response to actuation of the actuating device.

15 Claims, 6 Drawing Sheets

(51) Int. Cl.
*A45D 40/04* (2006.01)
*A45D 40/00* (2006.01)

(58) Field of Classification Search
CPC ..... A45D 40/00; A45D 40/06; A45D 40/16; A45D 40/18; A45D 40/205; A45D 2040/0043; A45D 2040/0056
See application file for complete search history.

(56) References Cited

U.S. PATENT DOCUMENTS

| | | | | |
|---|---|---|---|---|
| 5,496,122 | A | 3/1996 | Fattori | |
| 5,505,041 | A | 4/1996 | Harlan | |
| 6,095,708 | A | 8/2000 | Butaud | |
| 6,648,503 | B2 | 11/2003 | Tanaka et al. | |
| 9,307,822 | B2 * | 4/2016 | Adams | A45D 40/065 |
| 2010/0078344 | A1 * | 4/2010 | Martins | A45D 40/06 206/385 |

FOREIGN PATENT DOCUMENTS

| | | |
|---|---|---|
| KR | 100965241 | 6/2010 |
| WO | 2002/003830 | 1/2002 |
| WO | 2014/195645 | 12/2014 |

* cited by examiner

CONSUMABLE PRODUCT PACKAGING

BACKGROUND

Consumer products, such as, for example, under-arm protection ("UAP") devices, include a plastic housing having a consumable product positioned therein. When the consumer product is a UAP device, the consumable product typically includes deodorant or antiperspirant. Deodorant is a substance that is applied under the arms of a user to prevent body odor that is caused by the bacterial breakdown of perspiration (i.e., sweat). Antiperspirant is a subgroup of deodorant that aims at preventing perspiration and the body odor associated therewith.

Each time a user uses the consumer product, a portion of the consumable product (e.g., a deodorant stick) is used up, which gradually causes the level (e.g., height) of the consumable product to decrease below the upper edge of the housing. The user may turn a thumb screw coupled to the housing to raise the consumable product back above the upper edge of the housing so that the user may once again access the consumable product. Once the consumable product is used up or exhausted, the consumer product is typically thrown away, and a new consumer product is purchased and used.

BRIEF SUMMARY

A consumer product includes a housing defining an internal volume. A door is coupled to the housing, and the door is configured to move between an open position and a closed position. The door includes an actuating device positioned on a first side of the door and configured to be actuated by a user. The door also includes a first portion of a clutch positioned on a second side of the door. The first portion of the clutch rotates in response to actuation of the actuating device.

A consumer product includes a cartridge. The cartridge includes a sleeve and a riser. The sleeve and the riser at least partially define an internal volume of the cartridge. A consumable product is positioned within the internal volume of the cartridge. A first portion of a clutch is coupled to the riser. The consumable product is advanced within the cartridge by the riser in response to rotation of the first portion of the clutch. The consumer product also includes a housing defining an internal volume. The cartridge is configured to be inserted into the internal volume of the housing.

A consumer product includes a housing defining an internal volume. A door is coupled to the housing, and the door is configured to move between an open position and a closed position. The door includes an actuating device positioned on a first side of the door and configured to be actuated by a user. The door also includes a first portion of a clutch positioned on a second side of the door. The first portion of the clutch rotates in response to actuation of the actuating device. A cartridge is positioned within the internal volume of the housing. The cartridge includes a second portion of the clutch, and the second portion of the clutch is configured to rotate in response to rotation of the first portion of the clutch. A consumable product is positioned within the cartridge.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Figure 1:
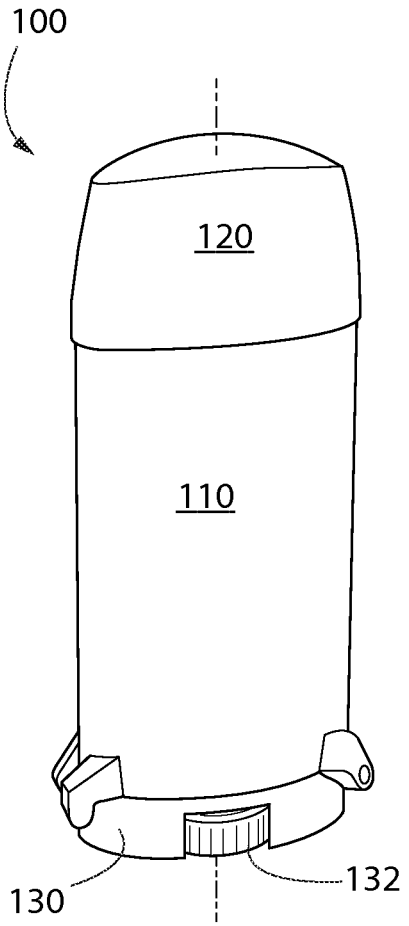
FIG. 1 depicts a perspective view of an illustrative consumer product, according to an embodiment.

FIG. 1 depicts a perspective view of an illustrative consumer product 100, according to an embodiment. The consumer product 100 may be or include a container for a consumable product. Although the consumer product 100 shown in the figures and described below is an under-arm protection ("UAP") device for dispensing deodorant or antiperspirant, as will be appreciated, in other embodiments, the consumer product 100 may be used for dispensing face or body salve (e.g., lip balm, moisturizer, sun block, sunburn relief, body lubricant), cosmetics (e.g., lipstick, eye and facial makeup, bronzer), adhesive, detergent (e.g., stain remover stick, soap), topical first aid or medication, office or artist supplies (e.g., eraser, paint, pencil, crayon, chalk), lubricant, shoe care (e.g., polish, conditioner, stain remover), condiments, or the like.

The consumer product 100 may include a housing 110 that defines an internal volume. A lid 120 may be positioned at least partially over an upper end of the housing 110 (e.g., via a friction fit). A door 130 may be coupled to a lower end of the housing 110. An actuating device 132 may be coupled to the housing 110 or the door 130. As shown, the actuating device 132 is a wheel (e.g., a "thumb wheel") that is coupled to the door 130.

Figure 2:
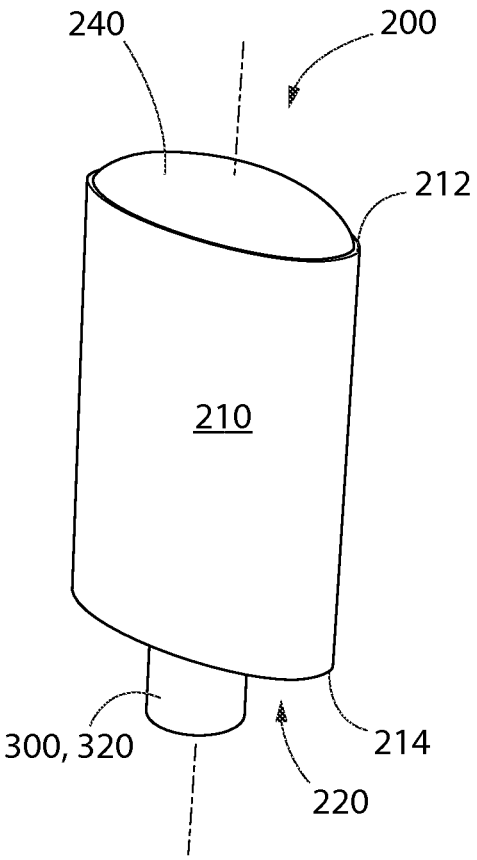
FIG. 2 depicts a perspective view of a cartridge that is configured to be loaded into the consumer product, according to an embodiment.

FIG. 2 depicts a perspective view of a cartridge 200 that is configured to be loaded into the consumer product 100, according to an embodiment. The cartridge 200 may be made of rigid plastic, flexibles & laminates, elastomeric plastic, rubber, silicone, wax, paper or other natural fiber (e.g., bamboo, leaf), starch, metal, glass, or the like, alone or in combination. The cartridge 200 may include a sleeve 210 having a cross-sectional shape that is elliptical (as shown), rectangular, circular, or the like. A first, upper end 212 of the sleeve 210 may be open. A riser 220 may initially be positioned proximate to a second, lower end 214 of the cartridge 200.

A consumable product 240 may be positioned within an internal volume of the cartridge 200. In the embodiment shown, the consumable product 240 may be or include deodorant or antiperspirant. The deodorant or antiperspirant may be in the form of a gel, a cream, a soft solid, or the like. However, as mentioned above, in other embodiments, the consumable product 240 may be or include face or body salve (e.g., lip balm, moisturizer, sun block, sunburn relief, body lubricant), cosmetics (e.g., lipstick, eye and face makeup, bronzer), adhesive, detergent (e.g., stain remover, soap), topical first aid or medication, office or artist supplies (e.g., eraser, paint, pencil, crayon, chalk), lubricant, shoe care (e.g., polish, conditioner, stain remover), condiments, or the like. Although not shown, in some embodiments, a domed cap, curved lid, or lidding film may be positioned over the upper end 212 of the cartridge 200 to protect the consumable product 240. More particularly, the cap or lid may close off the upper end 212 of the cartridge 200 so that the molten consumable product 240 may be cast into the cartridge 200, forming the leading edge of the consumable product 240 into the desired shape (e.g., curved or arcuate). The cap or lid may also protect the consumable product 240 from damage, contamination, exposure to the atmosphere, etc. Additionally, the cap or lid may prevent the consumable product 240 from smearing on the interior of the housing 110 as the cartridge 200 is loaded into the housing 110, as discussed below. The cap or lid may then be removed from the cartridge 200 after the cartridge 200 has been loaded into the housing 110.

A portion 320 of a clutch 300 may be coupled to the cartridge 200. As shown, the portion 320 of the clutch 300 may be coupled to and extending outward from the riser 220 of the cartridge 200. The clutch 300 is described in more detail below with respect to FIGS. 6-9. The riser 220 of the cartridge 200 may be configured to move with respect to the sleeve 210 of the cartridge 200 in response to rotation of the portion 320 of the clutch 300. More particularly, the riser 220 may move upward to raise or advance the consumable product 240 at least partially out of the upper end 212 of the cartridge 200 and of the housing 110.

Figure 3:
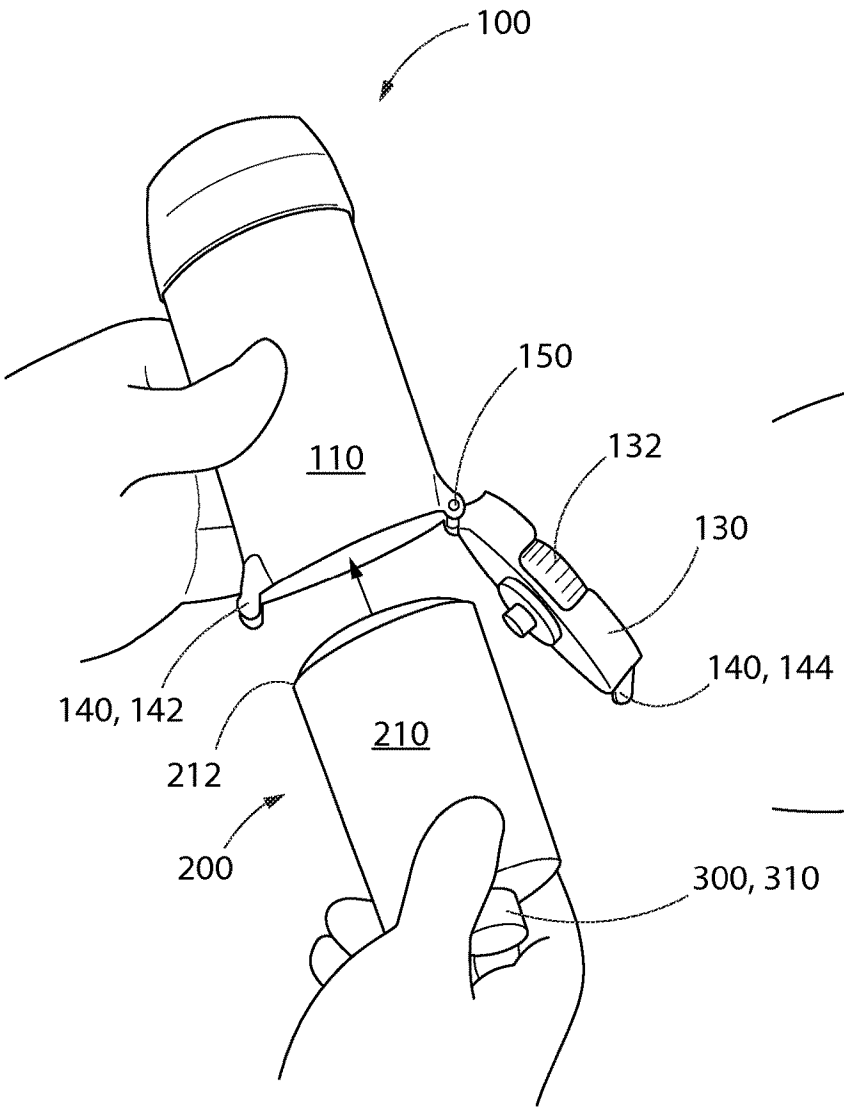
FIG. 3 depicts a perspective view of the cartridge being loaded into the consumer product, according to an embodiment.

FIG. 3 depicts a perspective view of the cartridge 200 being loaded into the consumer product 100, according to an embodiment. Prior to loading the cartridge 200 into the consumer product 100, the door 130 of the consumer product 100 may be opened. To open the door 130, a locking device 140 may first be unlocked. The locking device 140 may include a first portion 142 that is coupled to or integral with the housing 110 and a second portion 144 that is coupled to or integral with the door 130. The first portion 142 of the locking device 140 may be or include a female member, and the second portion 144 of the locking device 140 may be or include a male member, or vice versa. In one example, the first portion 142 of the locking device 140 may include one or more openings, and the second portion 144 of the locking device 140 may include a pin and a biasing member (e.g., a spring). The spring may be compressed to retract the pin from the opening(s), thereby unlocking the locking member 140. In another embodiment, rather than the locking device 140 including a biasing member, any spring action may come from temporary deformation of the housing 110 and/or the door 130. This may occur when, for example, the housing 110 and/or the cartridge 200 is injection molded.

Once the locking device 140 has been unlocked, the door 130 may be opened, as shown in FIG. 3. The door 130 may be coupled to the housing 110 using a hinge 150, and the door 130 may rotate into the open position about the hinge 150. In another embodiment, rather than rotating in the direction shown in FIG. 3, the door 130 may rotate while remaining within the same plane (e.g., a twisting or sliding motion). The plane of twisting or sliding may or may not be perpendicular to the central longitudinal axis through the housing 110. In yet another embodiment, the hinge 150 may be omitted, and the door 130 may be removed from the body 110 once the locking device 140 has been unlocked.

Once the door 130 has been opened, the user may determine whether an empty/used cartridge is present in the internal volume of the housing 110. If so, the empty/used cartridge may be removed from the internal volume and discarded. Once the internal volume of the housing 110 is empty, the cartridge 200 (e.g., a new/unused cartridge) may be inserted into the internal volume of the housing 110. As shown, the upper end 212 of the cartridge 200 may be inserted first. The cartridge 200 may be pushed into the internal volume of the housing 110 until a shoulder on the outer surface of the cartridge 200 contacts a corresponding shoulder on the inner surface of the housing 110, preventing further movement.

Figure 4:
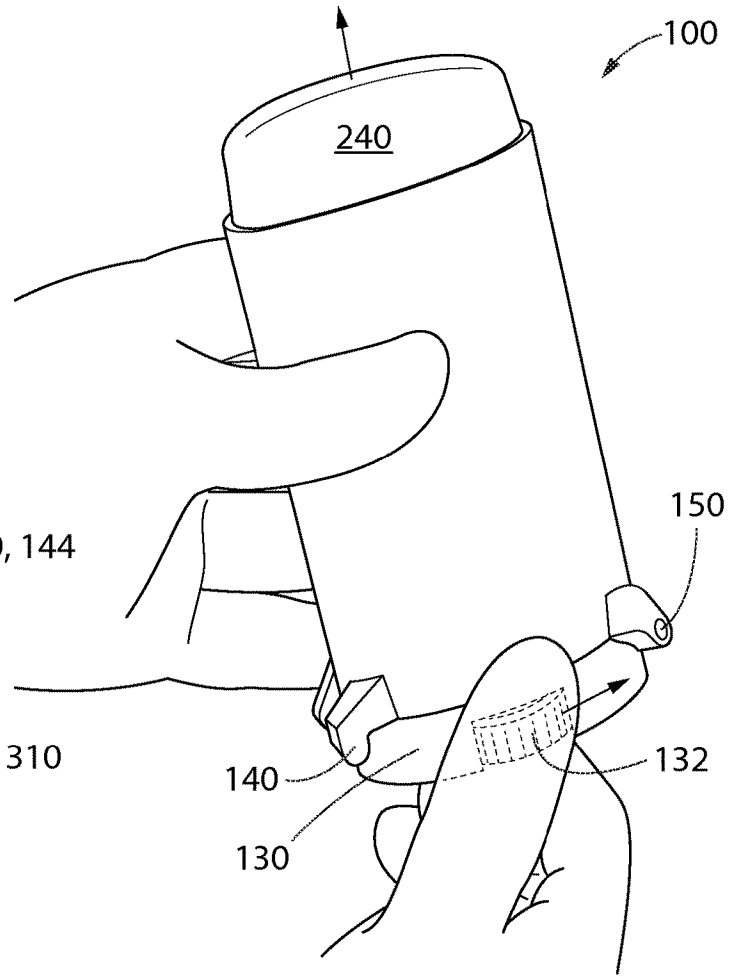
FIG. 4 depicts a perspective view of a consumable product being raised or advanced within the consumer product after the cartridge has been loaded into the consumer product, according to an embodiment.

FIG. 4 depicts a perspective view of the consumable product 240 being raised or advanced within the consumer product 100 after the cartridge 200 has been loaded into the consumer product 100, according to an embodiment. Once the cartridge 200 has been inserted into the housing 110, the door 130 may be closed (e.g., by rotating the door 130 about the hinge 150). Once the door 130 is closed, the door 130 may be secured in the closed position using the locking device 140. Using the example above, the spring may be compressed to allow the pin to be re-inserted into the openings. This may secure the cartridge 200 within the internal volume of the housing 110. The consumable product 240 may then be raised or advanced within the housing 110 by actuating (e.g., rotating) the actuating device 132, as shown in FIG. 4.

Figure 5:
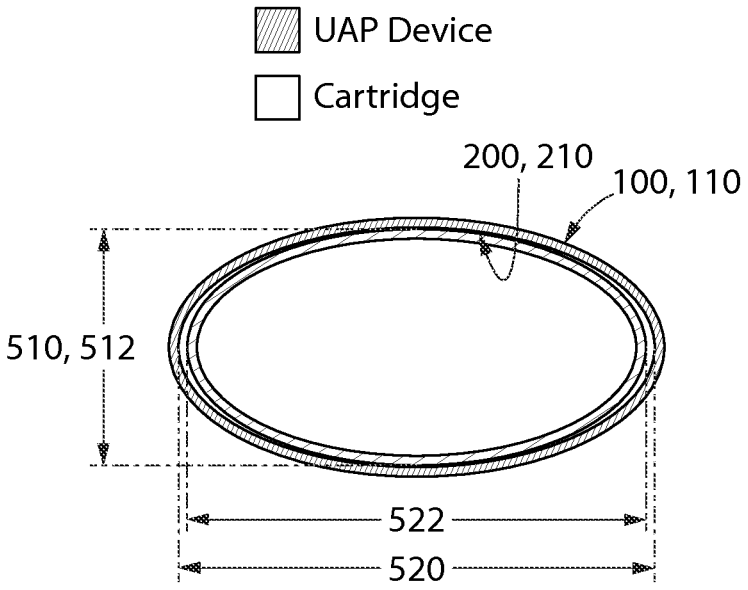
FIG. 5 depicts a cross-sectional view of the cartridge positioned within the consumer product, according to an embodiment.

FIG. 5 depicts a cross-sectional view of the cartridge 200 positioned within the housing 110 of the consumer product 100, according to an embodiment. As shown, the cartridge 200 and the housing 110 may each have a substantially elliptical cross-sectional shape, although other shapes are possible. In at least one embodiment, the cartridge 200 may be at least partially held in place within the housing 110 by a friction fit. This may prevent the cartridge 200 from falling out of the housing 110 as soon as the door 130 is opened. In the example shown in FIG. 5, the inner minor diameter 510 of the housing 110 may be sized to be less than or equal to the outer minor diameter 512 of the cartridge 200 to form the friction fit. The inner major diameter 520 of the housing 110 may be larger than the outer major diameter 522 of the cartridge 200 to provide a clearance or gap. The user may squeeze the housing 110 along the major diameter to deform the housing 110 as the cartridge 200 is being loaded into (or unloaded from) the housing 110. This may temporarily neutralize the friction fit along the minor diameter to allow the cartridge 200 to move within the housing 110.

Figure 6:
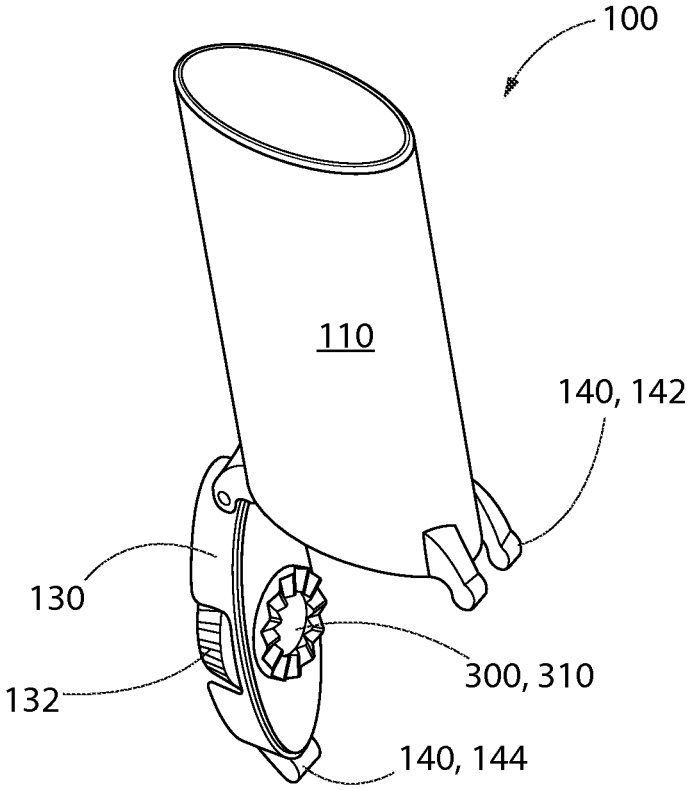
FIG. 6 depicts a perspective view of a door of the consumer product in an open position, according to an embodiment.

FIG. 6 depicts a perspective view of the door 130 of the consumer product 100 in an open position, according to an embodiment. The actuating device (e.g., wheel) 132 may be positioned on a first, outer side of the door 130. Another portion 310 of the clutch 300 may be positioned on a second, inner side of the door 130. This portion 310 of the clutch 300 may be coupled to, and configured to rotate with, the actuating device 132.

Figure 7:
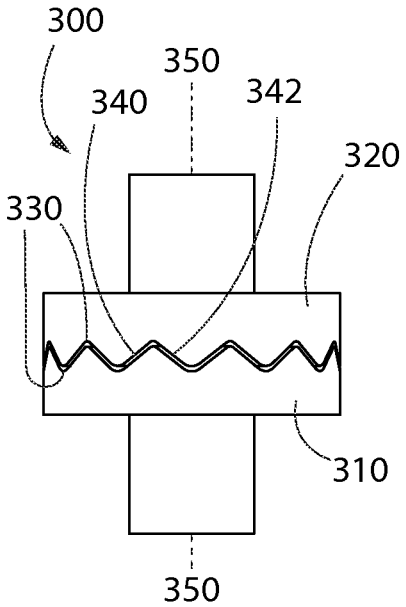
FIG. 7 depicts a side view of an illustrative clutch including first and second portions that are engaged with one another, according to an embodiment.
Figure 8:
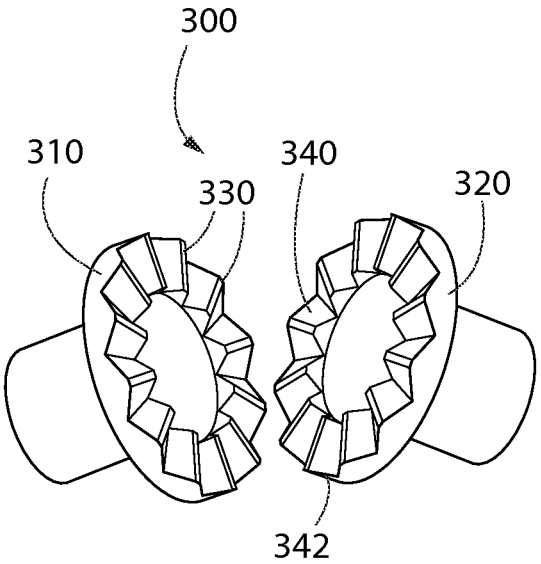
FIG. 8 depicts a perspective view of the first and second portions of the clutch separated from one another, according to an embodiment.

FIG. 7 depicts a side view of the clutch 300 showing the first portion 310 and the second portion 320 engaged with one another, and FIG. 8 depicts a perspective view of the clutch 300 showing the first portion 310 and the second portion 320 separated from one another, according to an embodiment. The inner surfaces of the first and second portions 310, 320 of the clutch 300 may include corresponding bevels or teeth 330. Each tooth 330 may be defined by opposing side walls 340, 342. The side walls 340, 342 may each be oriented at an angle with respect to a central longitudinal axis 350 through the clutch 300. As shown, the angle is about 45 degrees; however, as will be appreciated, in other embodiments, the angle may be from about 10 degrees to about 80 degrees, about 20 degrees to about 70 degrees, or about 30 degrees to about 60 degrees.

The teeth 330 may act to center the first and second portions 310, 320 of the clutch 300 about the central longitudinal axis 350 when the teeth 330 are engaged with one another. The teeth 330 may also act to promote engagement of the first and second portions 310, 320 of the clutch 300. For example, if the peaks of the teeth 330 on the first portion 310 happen to line up with the peaks of the teeth 330 on the second portion 320, the beveled side walls 340, 342 may help to guide each peak into a corresponding valley. In various embodiments, the number of teeth 330 on each portion 310, 320 of the clutch 300 may range from 4 to 18 or from 6 to 12.

Figure 9:
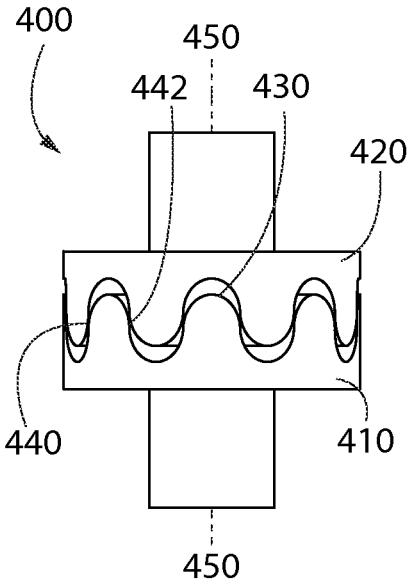
FIG. 9 depicts a side view of another illustrative clutch including first and second portions that are engaged with one another, according to an embodiment.
Figure 10:
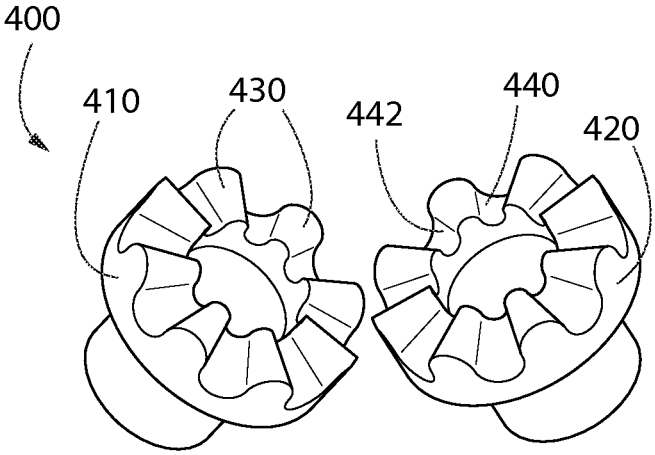
FIG. 10 depicts a perspective view of the first and second portions of the clutch from FIG. 9 separated from one another, according to an embodiment.

FIG. 9 depicts a side view of another illustrative clutch 400 showing the first portion 410 and the second portion 420 engaged with one another, and FIG. 10 depicts a top view of the clutch 400 of FIG. 9 showing the first and second portions 410, 420 separated from one another, according to an embodiment. The inner surfaces of the first and second portions 410, 420 of the clutch 400 may include corresponding bevels or teeth 430. Each tooth 430 may be defined by opposing side walls 440, 442. At least a portion of each side wall 440, 442 may be parallel to or aligned with, or nearly parallel to or aligned with, the central longitudinal axis 450 through the clutch 400. The vertical or nearly vertical portions of the side walls 440, 442 may allow the side walls 440, 442 to transmit more torque, or more torque without slipping, than the angled side walls 440, 442 shown in FIGS. 7 and 8. The vertical portions may also prevent the portions 410, 420 of the clutch 400 from pushing one another apart (e.g., slipping) during the transmission of torque, or delay the onset of slipping. Additionally, the vertical portions may allow the portions 410, 420 of the clutch 400 to remain engaged with one another or delay the onset of slipping even if the portions 410, 420 are slightly spaced apart from one another.

When a user rotates the actuating device (e.g., wheel) 132, this may cause the portion of the clutch 300, 400 in the door 130 to rotate. When the door 130 is closed, and the portions 310, 410, 320, 420 of the clutch 300, 400 are engaged with one another, the portion 310, 410 of the clutch 300, 400 in the door 130 may transmit the rotation/torque to the portion 320, 420 of the clutch 300, 400 on the cartridge 200. The portion 320, 420 of the clutch 300, 400 on the cartridge 200 may then transmit the rotation/torque to an elevation mechanism. The elevation mechanism may include a shaft that is coupled to the riser 220. When the rotation/torque is transferred to the shaft, the shaft may cause the riser 220 (and the consumable product 240) to advance toward or through the open end of the housing 110, for example using threads on the shaft. When the actuating device 132 is rotated the opposite direction, the riser 220 (and the consumable product 240) may both move away from the open end of the housing 110. In another embodiment, the elevation mechanism (e.g., the shaft, riser 220, etc.) may be coupled to or positioned within the housing 110 rather than the cartridge 200. This may allow the clutch 300, 400 to be omitted.

Figure 11:
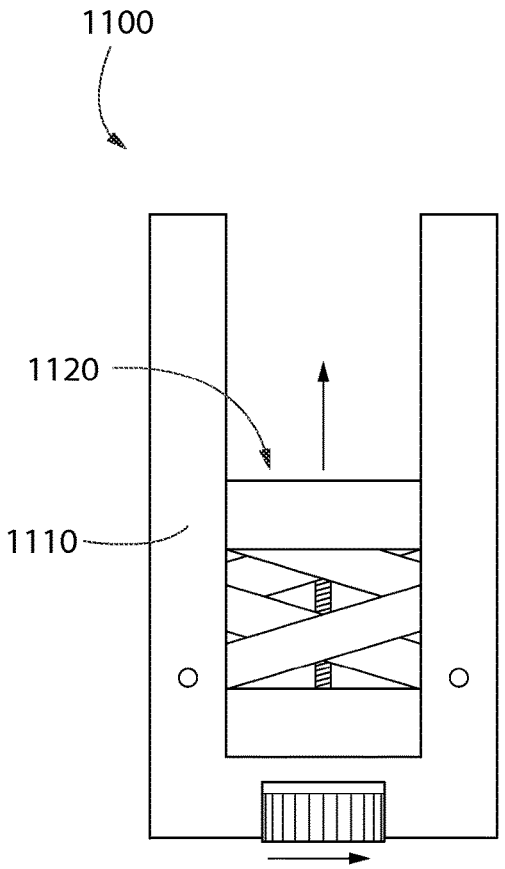
FIG. 11 depicts a front view of another illustrative consumer product showing an elevation mechanism in a first, lowered position, according to an embodiment.

FIG. 11 depicts a front view of another illustrative consumer product 1100 showing an elevation mechanism 1120 in a first, lowered position, according to an embodiment. The consumer product 1100 may include a housing 1110 defining an internal volume. The elevation mechanism 1120 may be positioned within the internal volume. When the elevation mechanism 1120 is in the first, lowered position, a ratio of a height of the elevation mechanism 1120 to a height of the housing 1110 may be from about 1:2 to about 1:5, about 1:2 to about 1:4, or about 1:2 to about 1:3.

Figure 12:
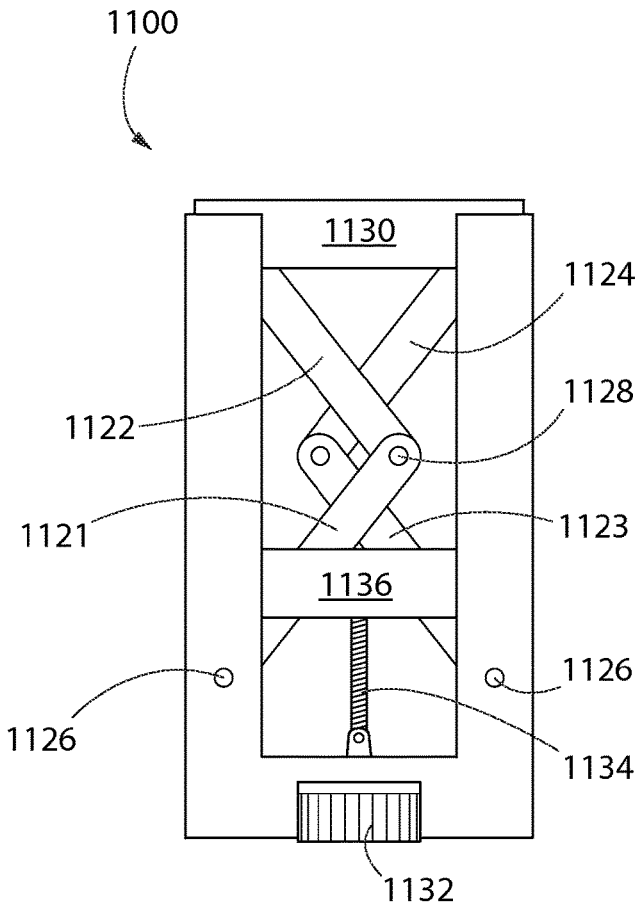
FIG. 12 depicts a front view of the consumer product of FIG. 11 showing the elevation mechanism in a second, raised position, according to an embodiment.

FIG. 12 depicts a front view of the consumer product 1100 of FIG. 11 showing the elevation mechanism 1120 in a second, raised position, according to an embodiment. The elevation mechanism 1120 may include a plurality of bar linkages 1121-1124. As shown, the elevation mechanism 1120 includes first and second sets of linkages 1121-1124 that are mirror images of one another, for example in a scissors-type configuration. The first set may include a lower linkage 1121 and an upper linkage 1122. Similarly, the second set may include a lower linkage 1123 and an upper linkage 1124.

The lower linkages 1121, 1123 may have one end coupled to the housing 1110 (e.g., via pins 1126) and an opposing end coupled to the upper linkages 1122, 1124 (e.g., via hinge pins 1128). The hinge pins 1128 may allow the upper linkages 1122, 1124 to rotate or pivot with respect to the lower linkages 1121, 1123. Ends of the upper linkages 1122, 1124 opposing the hinge pins 1128 may be coupled to a riser 1130.

The housing 1110 may include an actuating device (e.g., a wheel) 1132 that may be rotated by a user. A threaded shaft 1134 may be coupled to the actuating device 1132 and positioned within the interior volume of the housing 1110. The shaft 1134 may be configured to rotate together with the actuating device 1132. A pusher 1136 may be coupled to the shaft 1134. The pusher 1136 may include an opening, and the shaft 1134 may extend at least partially therethrough. The surface of the pusher 1136 defining the opening may include one or more internal threads that are configured to engage the threads of the shaft 1134.

In operation, the user may rotate the actuating device 1132 in a first direction, which may cause the shaft 1134 to rotate in the first direction. When the shaft 1134 rotates in the first direction, the threaded engagement between the shaft 1134 and the pusher 1136 may cause the pusher 1136 to move upward within the housing 1110. As the pusher 1136 moves upward, the pusher 1136 may exert a force on one or more of the linkages 1121-1124, causing the linkages 1121-1124 to pivot or scissor, which may cause the linkages 1121-1124 to raise the riser 1130 within the housing 1110 (e.g., to the second position, as shown in FIG. 12). Thus, the linkages 1121-1124 may function as a scissor lift. A consumable product may be positioned on the riser 1130 and be advanced upward for use by the movement of the riser 1130. In at least one embodiment, the consumable product may be part of a cartridge, as discussed above. The cartridge may be discarded once the consumable product has been used up, and then another, new cartridge may be inserted into the housing 1110.

When the user rotates the actuating device 1132 in a second, opposing direction, the shaft 1134 may rotate in the second direction. When the shaft 1134 rotates in the second direction, the threaded engagement between the shaft 1134 and the pusher 1136 may cause the pusher 1136 to move downward within the housing 1110. As the pusher 1136 moves downward, the pusher 1136 may exert a force on one or more of the linkages 1121-1124, which may cause the linkages 1121-1124 to lower the riser 1130 within the housing 1110 (e.g., to the first position, as shown in FIG. 11).

Figure 13:
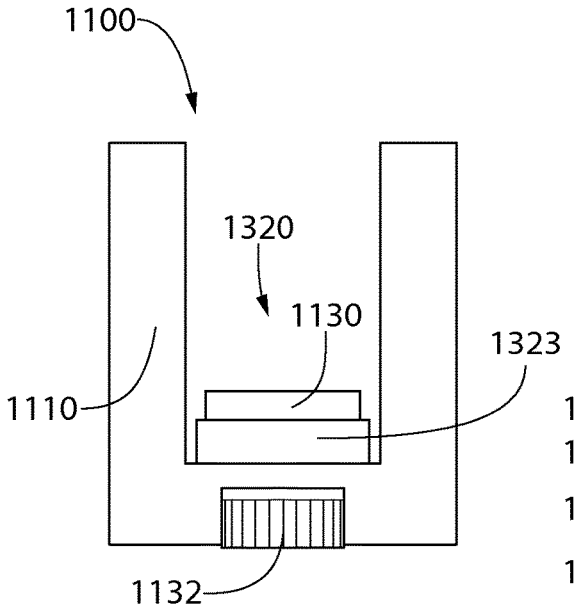
FIG. 13 depicts a front view of the consumer product of FIG. 11 showing another elevation mechanism in a first, lowered position, according to an embodiment.
Figure 14:
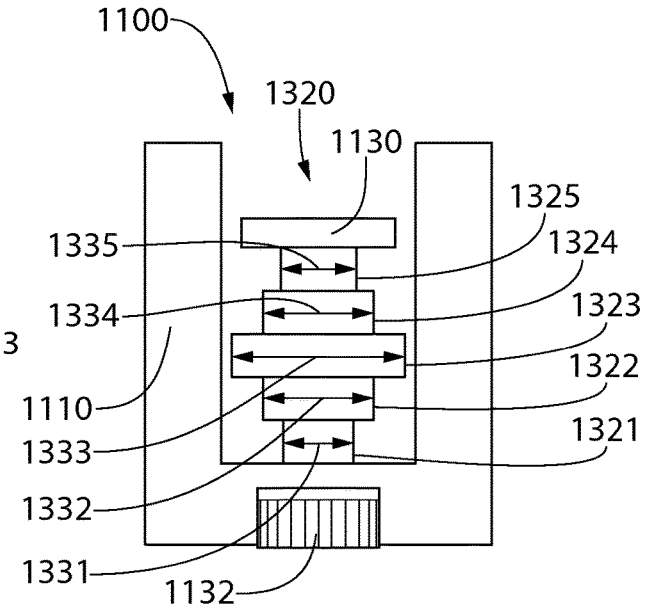
FIG. 14 depicts a front view of the consumer product showing the elevation mechanism of FIG. 13 in a second, raised position, according to an embodiment.

FIG. 13 depicts a front view of the consumer product 1100 of FIG. 11 showing another elevation mechanism 1320 in a first, lowered position, and FIG. 14 depicts a front view of the consumer product 1100 showing the elevation mechanism 1320 in a second, raised position, according to an embodiment. The elevation mechanism 1320 may include a plurality of tubular members (five are shown: 1321-1325). The tubular members 1321-1325 may have a cross-sectional shape that is a circle, an oval, a rectangle, or the like.

The tubular members 1321-1325 may be hollow and have varying cross-sectional lengths (e.g., diameters) 1331-1335 that allow the tubular members 1321-1325 to stack inside one another (as shown in FIG. 13) and to expand or telescope out into an expanded position (as shown in FIG. 14). For example, the cross-sectional length (e.g., diameter) 1332 of the tubular member 1322 may be less than the cross-sectional length (e.g., diameter) 1333 of the tubular member 1323 above it but greater than the cross-sectional length (e.g., diameter) 1331 of the tubular member 1321 below it. As shown in FIG. 14, the tubular member 1323 with the greatest cross-sectional length (e.g., diameter) 1333 may be positioned between at least one lower tubular member 1321, 1322 and at least one upper tubular member 1324, 1325.

Each tubular member (e.g., tubular member 1322) may be coupled to one or more other tubular members (e.g., tubular members 1321, 1323). In at least one embodiment, the tubular members 1321-1325 may be coupled together via a threaded engagement. For example, the inner surface of the tubular member 1322 may have threads on the inner surface thereof that engage corresponding threads on the outer surface of the tubular member 1321, and the outer surface of the tubular member 1322 may have threads on the outer surface thereof that engage corresponding threads on the inner surface of the tubular member 1323.

In operation, the user may rotate the actuating device 1132 in a first direction, which may cause one or more of the tubular members 1321-1325 to rotate. In at least one embodiment, some of the tubular members 1321-1325 may rotate while others of the tubular members 1321-1325 may not rotate. For example, the cross-sectional shape(s) of the housing 1110 and/or the riser 1130 may not be round. Thus, as the riser 1130 moves up and down within the housing 1110, the riser 1130 may not rotate within the housing 1110. As the riser 1130 may be coupled to at least one of the tubular members (e.g., tubular member 1325), the tubular member 1325 may also be prevented from rotating. In another embodiment, one or more of the tubular members 1321-1325 may be coupled to one or more vertical splines on the inner surface of the housing 1110 to prevent rotation.

When the one or more tubular members 1321-1325 rotate in the first direction, the threaded engagement between the tubular members 1321-1325 may cause the tubular members 1321-1325 to expand or move upward within the housing 1110 (e.g., like a telescope), as shown in FIG. 14. A ratio of the height of the elevation mechanism 1320 in the expanded position (FIG. 14) to the height of the elevation mechanism 1320 in the collapsed position (FIG. 13) may be from about 2:1 to about 4:1, or from about 3:1 to about 5:1.

The uppermost tubular member (e.g., tubular member 1325) may be coupled to the riser 1130. In at least one embodiment, the riser 220 of the cartridge 200 (see FIG. 2) may move together with the riser 1130 of the elevation mechanism 1320. The consumable product may be positioned on the riser 220 of the cartridge 200 and be advanced upward for use by the movement of the risers 220, 1130. The cartridge 200 may be discarded once the consumable product has been used up, and then another, new cartridge 200 may be inserted into the housing 1110.

When the user rotates the actuating device 1132 in a second, opposing direction, the one or more tubular members 1321-1325 may rotate in the second direction. When the one or more tubular members 1321-1325 rotate in the second direction, the threaded engagement between the tubular members 1321-1325 may cause the tubular members 1321-1325 to move downward and stack within one another within the housing 1110, as shown in FIG. 13.

Figure 15:
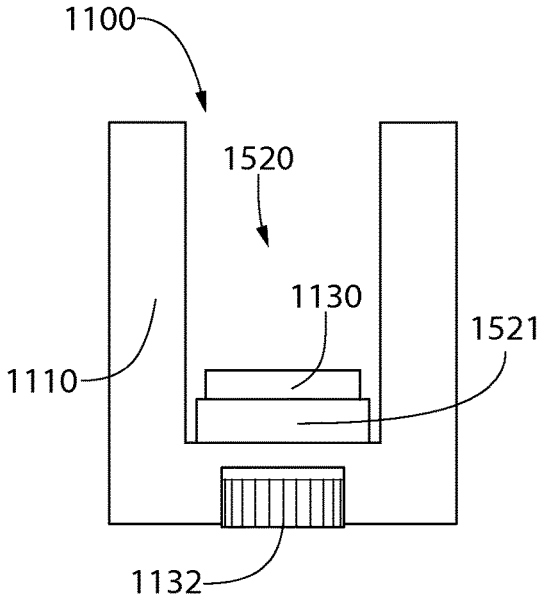
FIG. 15 depicts a front view of the consumer product of FIG. 11 showing another elevation mechanism in a first, lowered position, according to an embodiment.
Figure 16:
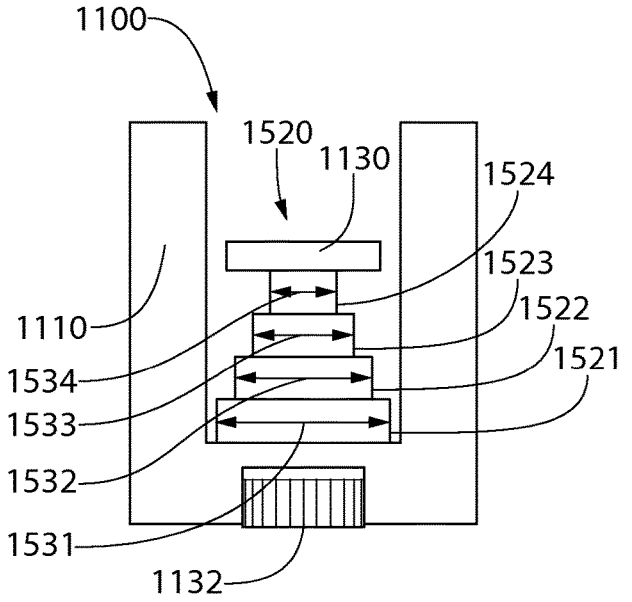
FIG. 16 depicts a front view of the consumer product showing the elevation mechanism of FIG. 15 in a second, raised position, according to an embodiment.

FIG. 15 depicts a front view of the consumer product 1100 of FIG. 11 showing another elevation mechanism 1520 in a first, lowered position, and FIG. 16 depicts a front view of the consumer product 1100 showing the elevation mechanism 1520 in a second, raised position, according to an embodiment. The elevation mechanism 1520 may include a plurality of tubular members (four are shown: 1521-1524). The tubular members 1521-1524 may have a cross-sectional shape that is a circle, an oval, a rectangle, or the like.

The tubular members 1521-1524 may be hollow and have varying cross-sectional lengths (e.g., diameters) 1531-1534 that allow the tubular members 1521-1524 to stack inside one another (as shown in FIG. 15) and to expand or telescope out into an expanded position (as shown in FIG.

16). For example, the cross-sectional length (e.g., diameter) 1532 of the tubular member 1522 may be less than the cross-sectional length (e.g., diameter) 1531 of the tubular member 1521 below it but greater than the cross-sectional length (e.g., diameter) 1533 of the tubular member 1523 above it. As shown in FIG. 16, the tubular member 1521 with the greatest cross-sectional length (e.g., diameter) 1531 may be positioned below the other tubular members 1522, 1523, 1524. Although not shown, in another embodiment, the tubular member 1521 with the greatest cross-sectional length (e.g., diameter) 1531 may be positioned above the other tubular members 1522, 1523, 1524 (e.g., coupled to the riser 1130).

Each tubular member (e.g., tubular member 1522) may be coupled to one or more other tubular members (e.g., tubular members 1521, 1523). In at least one embodiment, the tubular members 1521-1524 may be coupled together via a threaded engagement. For example, the inner surface of the tubular member 1522 may have threads on the inner surface thereof that engage corresponding threads on the outer surface of the tubular member 1523, and the outer surface of the tubular member 1522 may have threads on the outer surface there of that engage corresponding threads on the inner surface of the tubular member 1521.

In operation, the user may rotate the actuating device 1132 in a first direction, which may cause one or more of the tubular members 1521-1524 to rotate. In at least one embodiment, some of the tubular members 1521-1524 may rotate while others of the tubular members 1521-1524 may not rotate. For example, the cross-sectional shape(s) of the housing 1110 and/or the riser 1130 may not be round. Thus, as the riser 1130 moves up and down within the housing 1110, the riser 1130 may not rotate within the housing 1110. As the riser 1130 may be coupled to at least one of the tubular members (e.g., tubular member 1524), the tubular member 1524 may also be prevented from rotating. In another embodiment, one or more of the tubular members 1521-1524 may be coupled to one or more vertical splines on the inner surface of the housing 1110 to prevent rotation.

When the one or more tubular members 1521-1524 rotate in the first direction, the threaded engagement between the tubular members 1521-1524 may cause the tubular members 1521-1524 to expand or move upward within the housing 1110 (e.g., to resemble a wedding cake), as shown in FIG. 16. A ratio of the height of the elevation mechanism 1520 in the expanded position (FIG. 16) to the height of the elevation mechanism 1520 in the collapsed position (FIG. 15) may be from about 2:1 to about 4:1, or from about 3:1 to about 5:1.

The uppermost tubular member (e.g., tubular member 1524) may be coupled to the riser 1130. In at least one embodiment, the riser 220 of the cartridge 200 (see FIG. 2) may move together with the riser 1130 of the elevation mechanism 1520. The consumable product may be positioned on the riser 220 of the cartridge 200 and be advanced upward for use by the movement of the risers 220, 1130. The cartridge 200 may be discarded once the consumable product has been used up, and then another, new cartridge 200 may be inserted into the housing 1110.

When the user rotates the actuating device 1132 in a second, opposing direction, the one or more tubular members 1521-1524 may rotate in the second direction. When the one or more tubular members 1521-1524 rotate in the second direction, the threaded engagement between the tubular members 1521-1524 may cause the tubular members 1521-1524 to move downward and stack within one another within the housing 1110, as shown in FIG. 15.

What is claimed is:

1. A consumer product, comprising:

a housing defining an internal volume; and a door coupled to the housing, wherein the door is configured to move between an open position and a closed position, and wherein the door comprises:

an actuating device positioned on a first side of the door and configured to be actuated by a user; and a first portion of a clutch positioned on a second side of the door, wherein the first portion of the clutch rotates in response to actuation of the actuating device; and a cartridge defining an internal volume, wherein the cartridge is configured to be inserted into the internal volume of the housing when the door is in the open position; and a consumable product positioned within the internal volume of the cartridge;

wherein the housing and the cartridge both have substantially elliptical cross-sections, wherein a major inner diameter of the housing is greater than a major outer diameter of the cartridge, and wherein a minor inner diameter of the housing is less than or equal to a minor outer diameter of the cartridge.

2. The consumer product of claim 1, further comprising a hinge that couples the door to the housing.

3. The consumer product of claim 2, further comprising a locking mechanism that is configured to secure the door in the closed position.

4. The consumer product of claim 1, wherein the cartridge comprises:

a sleeve;

a riser; and a second portion of the clutch, wherein the first portion and the second portion of the clutch are configured to engage one another when the cartridge is inserted into the internal volume of the housing and the door is in the closed position.

5. The consumer product of claim 4, wherein the riser is configured to move with respect to the sleeve in response to rotation of the second portion of the clutch.

6. The consumer product of claim 5, wherein movement of the riser advances the consumable product through an open end of the cartridge.

7. The consumer product of claim 1, wherein the first portion of the clutch comprises a plurality of teeth, and wherein each tooth comprises first and second side walls that are oriented at an angle with respect to a central longitudinal axis through the clutch from 20 degrees to 70 degrees.

8. The consumer product of claim 1, wherein the first portion of the clutch comprises a plurality of teeth, each having first and second side walls, and wherein at least a portion of each of the first and second side walls is substantially parallel to a central longitudinal axis through the clutch.

9. A consumer product, comprising:

a cartridge comprising:

a sleeve;

a riser, wherein the sleeve and the riser at least partially define an internal volume of the cartridge;

a consumable product positioned within the internal volume of the cartridge; and a first portion of a clutch coupled to the riser, wherein the consumable product is advanced within the cartridge by the riser in response to rotation of the first portion of the clutch; and a housing defining an internal volume, wherein the cartridge is configured to be inserted into the internal volume of the housing;

wherein the housing and the cartridge both have substantially elliptical cross-sections, wherein a major inner diameter of the housing is greater than a major outer diameter of the cartridge, and wherein a minor inner diameter of the housing is less than or equal to a minor outer diameter of the cartridge.

10. The consumer product of claim 9, further comprising a door coupled to the housing, wherein the door is configured to move between an open position and a closed position, and wherein the door comprises:

an actuating device positioned on a first side of the door and configured to be actuated by a user; and a second portion of a clutch positioned on a second side of the door, wherein the second portion of the clutch rotates in response to actuation of the actuating device.

11. The consumer product of claim 10, wherein the first portion and the second portion of the clutch are configured to engage one another when the cartridge is inserted into the internal volume of the housing and the door is in the closed position.

12. The consumer product of claim 11, wherein the riser is configured to move with respect to the sleeve in response to actuation of the actuating device and rotation of the first and second portions of the clutch.

13. A consumer product, comprising:

a housing defining an internal volume;

a door coupled to the housing, wherein the door is configured to move between an open position and a closed position, and wherein the door comprises:

an actuating device positioned on a first side of the door and configured to be actuated by a user; and a first portion of a clutch positioned on a second side of the door, wherein the first portion of the clutch rotates in response to actuation of the actuating device;

a cartridge positioned within the internal volume of the housing, wherein the cartridge comprises a second portion of the clutch, and wherein the second portion of the clutch is configured to rotate in response to rotation of the first portion of the clutch;

a consumable product positioned within the cartridge; and a hinge that couples the door to the housing, wherein the hinge is positioned proximate to a first side of the door;

wherein the first portion of the clutch and the second portion of the clutch engage one another when the door is in the closed position.

14. The consumer product of claim 13, further comprising a locking mechanism that is configured to secure the door in the closed position, wherein the locking mechanism is positioned proximate to a second, opposing side of the door.

15. The consumer product of claim 14, wherein the housing and the cartridge both have substantially elliptical cross-sections, wherein a major inner diameter of the housing is greater than a major outer diameter of the cartridge, and wherein a minor inner diameter of the housing is less than or equal to a minor outer diameter of the cartridge.

* * * * *